US006227300B1

(12) United States Patent
Cunningham et al.

(10) Patent No.: US 6,227,300 B1
(45) Date of Patent: May 8, 2001

(54) SLIMBORE SUBSEA COMPLETION SYSTEM AND METHOD

(75) Inventors: Christopher E. Cunningham; Christopher D. Bartlett, both of Spring, TX (US)

(73) Assignee: FMC Corporation, Houston, TX (US)

( * ) Notice: Subject to any disclaimer, the term of this patent is extended or adjusted under 35 U.S.C. 154(b) by 0 days.

(21) Appl. No.: 09/168,301

(22) Filed: Oct. 7, 1998

Related U.S. Application Data

(60) Provisional application No. 60/061,293, filed on Oct. 7, 1997.

(51) Int. Cl.[7] ..... E21B 33/038

(52) U.S. Cl. ..... 166/339; 166/345; 166/363; 166/365; 166/368

(58) Field of Search ..... 166/339, 348, 166/345, 363, 365, 368, 88.1, 65.1, 75.14

(56) References Cited

U.S. PATENT DOCUMENTS

| | | | | |
|---|---|---|---|---|
| 3,635,435 | | 1/1972 | Perison, Sr. | 248/475 A |
| 3,653,435 | * | 4/1972 | Reistle, III et al. | 166/366 |
| 4,147,221 | | 4/1979 | Ilfrey et al. | 175/7 |
| 4,491,176 | | 1/1985 | Reed | 166/65.1 |
| 4,607,691 | | 8/1986 | Bridges | 166/88 |
| 4,903,774 | | 2/1990 | Dykes et al. | 166/363 |
| 5,213,162 | | 5/1993 | Iato | 166/341 |
| 5,280,766 | * | 1/1994 | Mohn | 166/368 |
| 5,372,199 | | 12/1994 | Cegielski et al. | 166/368 |
| 5,503,230 | | 4/1996 | Osborne et al. | 166/344 |
| 5,544,707 | | 8/1996 | Hopper et al. | 166/382 |
| 5,566,758 | * | 10/1996 | Forester | 166/285 |
| 5,575,336 | | 11/1996 | Morgan | 166/330 |
| 5,868,204 | | 2/1999 | Pritchett et al. | 166/368 |
| 5,971,077 | * | 10/1999 | Lilley | 166/368 |
| 6,015,013 | * | 1/2000 | Edwards et al. | 166/360 |

* cited by examiner

*Primary Examiner*—Hoang Dang
(74) *Attorney, Agent, or Firm*—Gary L. Bush; Mayor, Day, Caldwell & Keeton, LLP

(57) ABSTRACT

A slimbore marine riser and BOP are provided for a subsea completion system which includes a tubing spool secured to a wellhead at the sea floor. The tubing spool has an internal landing profile for a reduced diameter tubing hanger which is arranged and dimensioned to pass through the bore of the riser and BOP at the end of a landing string. The tubing hanger, arranged and designed to be sealingly positioned in the tubing spool landing profile, has a production bore and a relatively large multiplicity of electric and hydraulic passages which terminate at a top end of the hanger with vertically extending electric and hydraulic couplers. A passage is provided through the body of the tubing spool which provides communication from above the tubing hanger to the well annulus below the hanger. A remotely controllable valve is placed in the annulus bypass passage. After the hanger is positioned in the tubing spool, the BOP may be set aside the wellhead, so that a substantially conventional xmas tree (with a BOP adaptor connected to its top profile) may be secured at its bottom end to the tubing spool. Subsequently the BOP may be secured to the top of the xmas tree by means of the BOP adaptor. After downhole and subsea completion operations are finished, the BOP and marine riser may be disconnected from the xmas tree by unlocking the bottom of the BOP adaptor from the top of the xmas tree. A tree cap can then be installed in the top profile of the xmas tree. For well intervention operations, a conventional BOP or LMRP of convenience can be reestablished to the top of the xmas tree via the BOP adaptor.

58 Claims, 9 Drawing Sheets

SLIMBORE SUBSEA COMPLETION SYSTEM AND METHOD

CROSS REFERENCE TO RELATED APPLICATION

This application claims priority from U.S. provisional application Ser. No. 60/061,293, filed Oct. 7, 1997.

BACKGROUND OF THE INVENTION

1. Field of the Invention

This invention relates generally to subsea completion systems. In particular, the invention concerns a subsea completion system which may be considered a hybrid of conventional xmas tree (CXT) and horizontal xmas tree (HXT) arrangements. More specifically, this invention relates to a marine riser/tubing hanger/tubing spool arrangement with the capability of passing production tubing and a large number of electric and hydraulic lines within a relatively small diameter.

This invention also relates to a method and arrangement whereby both "reduced bore" ("slimbore") and conventional BOP/marine riser systems may be interfaced both to the tubing spool and the xmas tree, such that the BOP stack need not be retrieved in order that the xmas tree may be installed, and so that the xmas tree need not be deployed with or interfaced at all by a conventional workover/intervention riser, if this is not desired.

2. Background and Objects of the Invention

The invention described below originates from an objective to provide a subsea completion system that is capable of being installed and serviced using a marine riser and BOP stack, especially those of substantially reduced size and weight as compared to conventional systems. One objective is to replace a conventional 19" nominal bore marine riser and associated 18¾" nominal bore BOP stack with a smaller bore diameter system, for example in the range between 14" and 11" for the marine riser and BOP stack. Preferably the internal diameter of the BOP stack is under 12". If the riser bore diameter is under 12", it will require only 40% of the volume of fluids to fill in comparison to 19" nominal conventional systems. The smaller riser/BOP stack and the resulting reduced fluids volume requirements result in a significant advantage for the operator in the form of weight and cost savings for the riser, fluids, fluid storage facilities, etc. These factors combine to increase available "deck loading" capacity and deck storage space for any rig using the arrangement of the invention and facilitates operations in deeper water as compared to arrangements currently available.

At the same time, it is desirable to accommodate a large number of electric (E) and hydraulic (H) conduits through the tubing hanger. A currently available tubing hanger typical of those provided throughout the subsea completion industry can accommodate a production bore, an annulus bore, and up to one electric (1E) plus five hydraulic (5H) conduits. An important objective of the invention is to provide a new system to accommodate production tubing and provide annulus communication, and to provide a tubing hanger that can accommodate (ideally) as many as 2E plus 7H independent conduits. The requirement for the large number of E and H conduits results from the desire to accommodate downhole "smart wells" hardware (smart wells have down-hole devices such as sliding sleeves, enhanced sensing and control systems, etc., which require conduits to the surface for their control).

It is also an object of the invention to provide a subsea system that obviates the need for a conventional, and costly, "open sea" capable workover/intervention riser. The object is to provide a system which allows well access via a BOP stack/marine riser system on top of a subsea xmas tree. Such a system is advantageous, especially for deep water applications, where the xmas tree can be installed without first having to retrieve and subsequently re-run the BOP stack. Another important object of the invention is to provide a system which allows future intervention using a BOP stack/marine riser or a more conventional workover/intervention riser.

SUMMARY OF THE INVENTION

A new tubing hanger/tubing spool arrangement is provided which includes advantageous features from conventional xmas tree and horizontal xmas tree designs. The new arrangement provides a tubing spool for connection to a subsea wellhead below, and for a first connection above to a slimbore or conventional BOP stack for tubing hanging operations and subsequently to a xmas tree for production operations. The tubing hanger is sized to pass through the bore of a slimbore blowout preventer stack and a slimbore riser to a surface vessel. The tubing hanger is arranged and designed to land and to be sealed in an internal profile of the tubing spool. The tubing hanger has a central bore for production tubing and up to at least nine conduits and associated vertically facing couplers for electric cables and hydraulic fluid passages. The tubing spool has a passage in its body which can route fluids around the tubing hanger sealed landing position so that annulus communication between the well bore (below) and the BOP stack or xmas tree (above) is obtained. A remotely operable valve in the annulus passage provides control over the annulus fluid flow.

The method of the invention includes slimbore marine riser and slimbore BOP stack operations for landing the reduced diameter tubing hanger in the tubing spool using a landing string. Conventional sized BOP stacks and marine risers may also be used for the various operations. The slimbore BOP stack and completion landing string is set aside of the tubing spool, and a xmas tree is connected to the top of the tubing spool. The xmas tree may be deployed to the tubing spool independently of the riser(s) connected to and/or deployed inside of the BOP stack. A BOP adaptor is provided to connect the top of the conventional sized xmas tree to the bottom of the slimbore or conventional sized BOP stack and marine riser. The landing string, with tubing hanger running tool at its bottom end, is used along with other equipment to provide a high pressure conduit to the surface for production fluids, and to serve as a mandrel around which BOP rams and/or annular BOPs may be closed to create a fluid path for the borehole annulus which is accessed and controlled by the BOP choke and kill conduits.

After the BOP stack is removed by disconnecting the BOP adaptor from the top of the xmas tree, the xmas tree may be capped. The tree cap can be removed later to allow well intervention operations, and the slimbore or a conventional sized BOP and marine riser along with the BOP adaptor, can be run onto the xmas tree. Alternatively, a conventional workover/intervention riser may be used to interface the top of the xmas tree.

BRIEF DESCRIPTION OF THE DRAWINGS

The objects, advantages, and features of the invention will become more apparent by reference to the drawings which are appended hereto and wherein like numerals indicate like parts and wherein an illustrative embodiment of the invention is shown, of which.

DESCRIPTION OF THE INVENTION

Figure 1A:
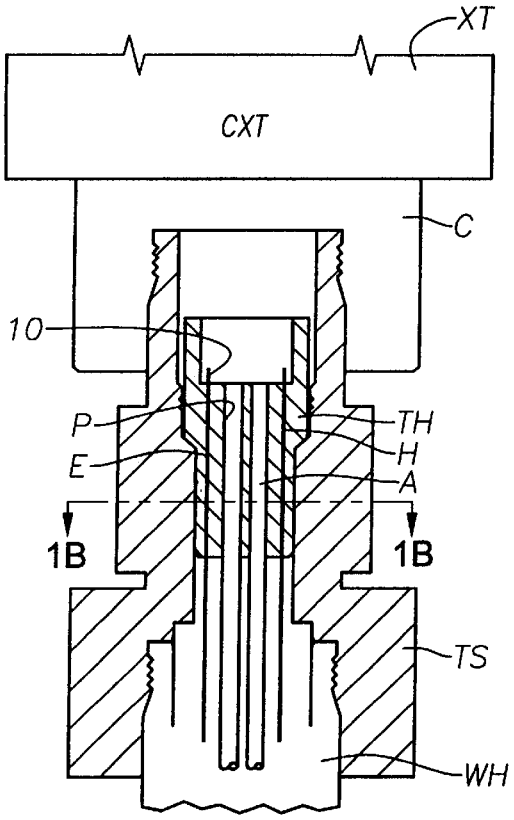
FIGS. 1A, 1B, 2, 3 and 4 are diagrammatic sketches of various arrangements for providing an annulus conduit, a production conduit, and conduits for electric (E) and hydraulic (H) communication via conductors which extend from a surface location above a subsea well to the well below.
Figure 1B:
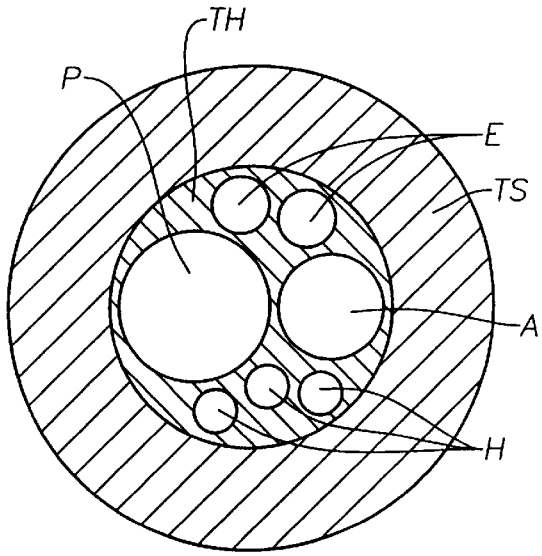

FIGS. 1A and 1B schematically illustrate a possible tubing hanger (TH) and xmas tree (XT) arrangement for meeting the objectives as described above. FIG. 1A illustrates a tubing spool TS to which a conventional xmas tree XT is attached by means of a connector C. The tubing spool TS is secured to a wellhead housing WH. The outer profile of tubing spool TS shown is referred to as an 18¾" mandrel style (the 18¾" designation referring to the nominal bore of the BOP stack normally associated with the subject profile) but with an internal diameter of under 11" or 13⅝" depending on the BOP or marine riser internal diameter dimension. A tubing hanger TH is landed in the internal bore of tubing spool TS, and the tubing hanger TH has an annulus conduit A, a production conduit P, and several E and H ports or conduits through it. Couplers 10 are illustrated schematically at the top of hanger H. FIG. 1B is a cross section (taken along lines 1B—1B of FIG. 1A) of the tubing hanger TH of FIG. 1A and illustrates that for a tubing hanger TH with specified diameters for the production bore P and the annulus bore A, only a few electric and hydraulic bores of predetermined diameters can be provided.

Figure 2:
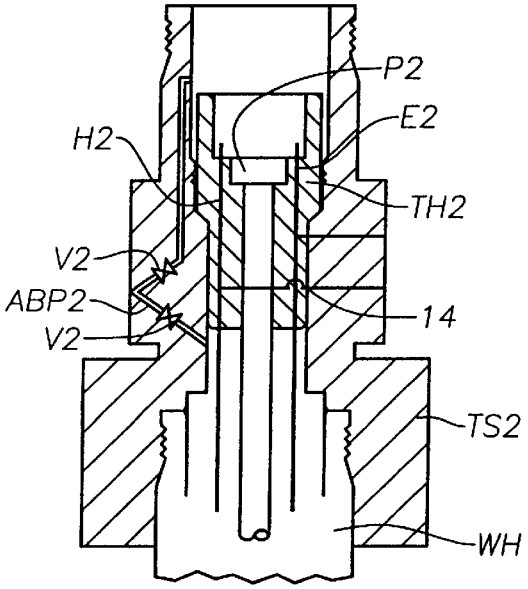

FIG. 2 schematically illustrates another arrangement for possibly meeting the objectives of the invention. A tubing spool TS2 is provided which includes an annulus bore bypass ABP2 with valves V2. A tubing hanger TH2 has a production bore P2 and electric and hydraulic conduits E2, H2. Such conduits are bores through the body of the hanger which communicate with vertical and horizontal couplers 12, 14. The tubing spool TS2 can accept either a conventional vertical xmas tree CXT or a horizontal Christmas tree HXT. The advantage of the arrangement of FIG. 2 over that of FIG. 1A is that it includes a bypass annulus bore ABP2 in the tubing spool TS2 itself which provides room for the production bore P2 and an increased number of E and H conduits in the tubing hanger TH2 (as compared to the arrangement of FIGS. 1A, 1B). As mentioned above, it is assumed that the outer diameter of TH2 is the same as that of TH, i.e., under about 11" or 13⅝" depending on the BOP and marine riser dimensions.

Figure 3:
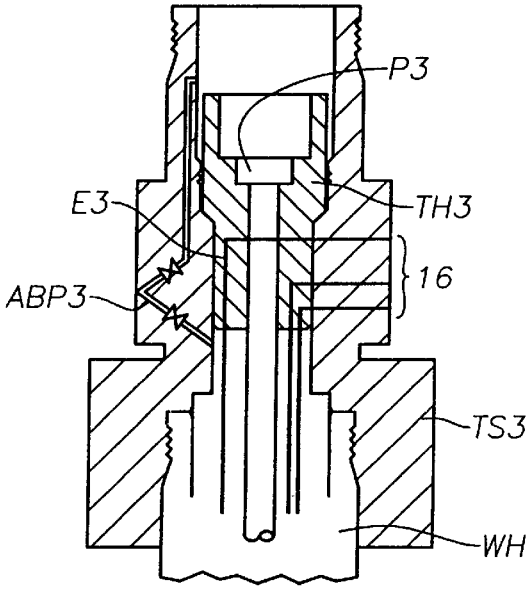

FIG. 3 is another schematic illustration, which is similar to that of FIG. 2. However, only horizontal couplers 16 for the E and H channels are provided. Such an arrangement is disadvantageous in that continuous vertical communication between the equipment installation vessel and downhole electric and hydraulic functions is not accommodated.

Figure 4:
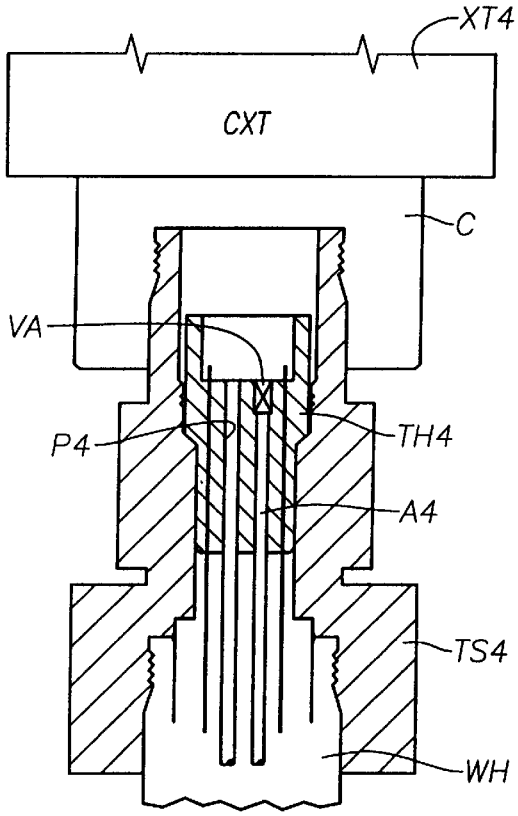

FIG. 4 is another schematic illustration of a possible tubing hanger TH4/conventional vertical bore xmas tree combination where a xmas tree XT4 is secured to a tubing spool TS4. A concentric tubing hanger TH4 is provided in tubing spool TS4 and has annulus bore or bores A4 and production bore P4 through it. Valve or valves VA are provided in bore or bores A4. The arrangement of FIG. 4 provides only vertical controls access.

Figure 5A:
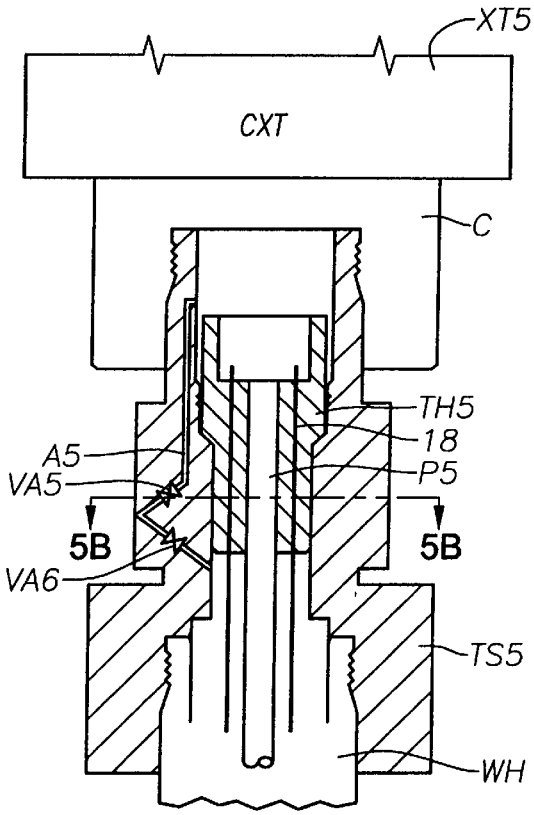
FIGS. 5A and 5B are diagrammatic sketches of a preferred embodiment of an arrangement for providing an annulus conduit, a production conduit and electric (E) and hydraulic (H) conduits from above a subsea well to the well below in which the tubing hanger outer diameter is minimized while maximizing the number of E and H lines and providing vertical coupling of same to a conventional monobore or dual bore xmas tree.
Figure 5B:
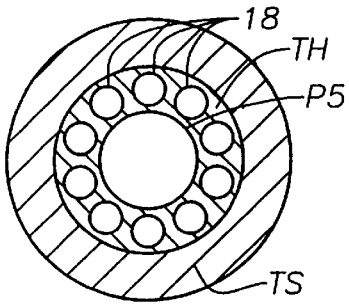

FIGS. 5A and 5B schematically show the preferred embodiment of an arrangement to meet the objectives stated above. The arrangement of FIGS. 5A and 5B provide the best features of a CXT and an HXT in a hybrid arrangement, where a valved annulus bypass A5 is provided in the tubing spool TS5, and with a production bore P5 and an increased number of E and H conduits 18 provided therein. In the preferred arrangement of FIG. 5A, the tubing spool TS5 is arranged and designed to pass an 8½" bit. Its top outer profile should be compatible with a standard 18¾" system so as to accept a conventional sized CXT and standard sized BOP, as well as a slimbore BOP. Ideally it should have a bore protector and its upper internal profile (ID) diameter would be on the order of 11" or 13⅝", depending on the bore size of the smallest BOP system to be interfaced. Ideally up to nine, but as many as 12-to-14 ports or conduits 18 of 1.50" nominal diameter can be provided in tubing hanger TH5. Of these ports, some may be required for alignment purposes, depending on the alignment method adopted.

The FIGS. 1 through 5 provide alternative tubing hanger (TH) and xmas tree (XT) combinations which are examined for their capability to meet the objectives as described above.

The arrangement of FIGS. 5A and 5B offer certain advantages regarding the desired specific objectives. The annulus communication path or passage A5 is routed via the body of the tubing spool TS5 and passes "around" rather than "through" the tubing hanger, as is the case for FIGS. 1A, 1B and 4. In other words, a passage is provided around the sealed landing position between the tubing spool TS5 and the tubing hanger TH5. This feature provides more space to accommodate a relatively large number of E and H conduits. As with horizontal tree (HXT) arrangements, the annulus passage A5, whether integrated with the body of the TS or attached externally by some means, is typically fitted with one or more valves VA5, VA6 in order to enable remote isolation/sealing of the annulus flow path. Whereas a conventional "vertical dual bore" (VDB) xmas tree/completion system requires that a wireline plug be installed into the annulus bore of the conventional tubing hanger (or thereabouts) in order to seal it off, providing a valved annulus bypass port achieves savings in time and money associated with installing/retrieving such a plug. Since the valves VA5, VA6 of FIG. 5A are preferably (but not limited to) gate valves, the reliability of the annulus pressure barrier is also improved with the arrangement of FIG. 5A as compared to a wireline plug. It is also notable that the annulus bypass conduit A5 is contained as part of a tubing spool assembly TS5 and not in the body of the tree as would be the case for HXTs.

Tubing spools ("TS"), also called tubing heads, offer advantages and disadvantages. Some of the more common characteristics associated with tubing spools include:

(1) provides "clean" interfaces for a tubing hanger ("TH"), (2) reduces stack-up tolerances to "machine tolerances", (3) can be equipped with an orientation device, thereby minimizing TH "rotational" tolerance range and possibly removing the need to modify BOP stacks so that they can orient the TH (as is typically required for conventional vertical dual bore VDB systems), (4) can incorporate flowline/umbilical interface and parking facilities, (5) represent an additional capital expenditure compared to both CXT systems (where the TH is landed directly in the wellhead) and HXT systems (TH landed in the body of the HXT), (6) may require an extra trip (i.e., installation of TS) as compared to CXT and HXT systems, and (7) requires that the BOP be removed from the wellhead so that the TS may be installed onto the wellhead, and the BOP subsequently landed on the TS, and the downhole completion/TH then subsequently installed.

While the above list is by no means complete, it shows advantages and disadvantages of a tubing spool/tubing hanger (TS/TH) arrangement as compared to CXT systems and HXT systems. The last three characteristics (5,6,7), represent drawbacks for a TS completion, especially because HXT systems provide most of the benefits of a TS without most of the its disadvantages. Nevertheless, the advantages provided by the design of FIGS. 5A, 5B outweigh the disadvantages identified above, especially since the impact of the drawbacks are mediated in the design of the invention.

An important advantage of the arrangement of FIGS. 5A and 5B is its capability to pass a very large number of E and H lines 18 through the tubing hanger TH5 while requiring only a very small bore subsea BOP and marine riser. For example purposes only, a tubing hanger TH5 capable of suspending 4½" production tubing and providing on the order of 10 (combined total) E and H passages 18 of 1½" diameter can be passed through a roughly 11" bore (drift) BOP stack and an associated "slimbore" marine riser (12" ID).

A comparably capable HXT tubing hanger system would likely require a 13⅝" nominal bore BOP and a 14" ID (approximate) bore marine riser. The cross sectional area of a 19" bore marine riser (typically used with 18¾" bore BOP stacks) is 283.5 in.$^2$. Cross sectional areas for 14" and 12" risers are 153.9 in.$^2$ and 113.1 in.$^2$, respectively. The volume of fluids required to fill these risers are 100%, 54.3% and 39.9% respectively, using the 19" riser as the base case. Fluids savings translate into direct cost savings, and indirect savings associated with reduced storage requirements, pumping requirements, etc. Furthermore, "variable deck loading" is improved since smaller risers, less fluid, less fluid storage, etc., all weigh less. A 12" bore riser requires only 73.5% as much fluid volume as a 14" riser (a significant advantage for the system of this invention when compared even to reduced bore HXT systems). As the water depth for subsea completions increases, the issue of variable deck loading becomes more important.

The arrangement of FIGS. 5A and 5B has characteristics of a conventional xmas tree completion system and an HXT (horizontal xmas tree) completion system. It is a hybrid of features of a CXT and an HXT connected to a well head, but it most closely resembles a CXT with a tubing spool.

Another significant advantage of the slimbore subsea completion system of FIGS. 5A and 5B is the manner in which E and H conduits 18 are handled. It is generally recognized in the subsea well completion/intervention industry that whenever (especially) electric lines are required to be installed into a wellbore, the most common failure mode is that the cables and/or end terminations become damaged during the installation process. It is, therefore, highly desirable that electric circuit continuity be monitored throughout the installation activity (i.e., from the time that the downhole electric component is made up into the completion string until the time that the TH is landed and tested). Whereas there have been many cases in which a downhole electric problem has been detected (i.e., communication with a downhole pressure and temperature gauge lost), and simply ignored (i.e., deemed not worth the cost to pull the completion to replace the damaged component). This will likely not be an acceptable practice where "smart well" hardware is integrated with the completion—there is too much money and potential well productivity impact involved. It is, therefore, important that electric circuit continuity can be monitored throughout the completion installation process.

The most efficient method traditionally employed to monitor downhole functions during the completion installation process has been to route lines from each downhole component through a series of interfaces all the way back to the surface. In the system of this invention, which is typical of CXT systems regarding electric conduit respects, lines are run from the downhole components alongside the production tubing (clamped thereto) and terminated into the bottom of the TH. The lines are routed through the TH and are equipped with "wet mateable" devices which have the capability to conduct power and data signals across the TH/TH Running Tool (THRT) interface during TH installation and related modes, and across the TH/xmas tree interface during production and intervention modes, etc. From the THRT bottom face, the electric conduits are typically routed through a variety of components (possibly ram and/or annular BOP seal spools, subsea test tree (SSTT)/emergency disconnect (EDC) latch device, E/H control module, etc.) until they are ultimately combined into a bundle of lines (E and H) typically referred to as an umbilical. The umbilical conveniently can be reeled in or out for re-use in a variety of applications.

After the TH has been installed and tested, one completion scenario associated with the invention (one that is typically used throughout the industry) is for the landing string (LS, i.e., THRT on "up") to be retrieved, the BOP stack/marine riser disconnected and retrieved, and the xmas tree installed using typically a workover/intervention riser system. The xmas tree engages the same E and H control line (wet mateable) couplers at the top of the TH as previously interfaced by the THRT. It is a special attribute of the system of the invention that the THRT need only be unlatched from the TH and the LS lifted up into or just above the BOP stack, and the BOP stack need only be removed from the wellhead a sufficient lateral distance to facilitate installation of the xmas tree onto the TS. Specifically, the XT may be lowered by an independent hoisting unit and installed onto the wellhead using a cable or tubing string with ROV assistance, etc., or the xmas tree may previously have been "parked" at a laterally displaced seabed staging position for movement onto the wellhead using the LS and/or BOP stack/marine riser, for example.

The procedure for installation of an HXT is different in that it is often preferred that no umbilical be used as part of the TH deployment process. During an HXT installation the SCSSV(s) are typically locked "open" prior to deployment of the TH, a purely mechanical or "external pressure" (possibly "staged") operated THRT/TH is employed, and no communication with downhole components is provided. Once the TH has been engaged (and typically locked) into the bore of the HXT, electric and hydraulic communication between the surface and downhole is established via the HXT using an umbilical run outside of the marine riser. A remotely operated vehicle (ROV) is typically used to engage the various couplers in a radial direction (not a vertical direction) into the TH from the HXT body (horizontal plane of motion). One supplier also employs "angled" interfacing devices for the hydraulic conduits (i.e., between a tapered lower surface of the TH and a shoulder in the HXT bore) which are engaged passively as part of the TH landing/locking operation.

It is the generally horizontal/radial orientation of couplers of especially the electric lines typical of an HXT system that tends to drive up the required diameter of the associated TH, and hence the required bore size for the related BOP stack and marine riser used to pass it. It is, of course, conceivable that a new design HXT and/or (wet-mateable electric) controls interface could be developed that would permit HXT TH size reduction (i.e., more compact coupler, or other than horizontal arrangement, or both, etc.), but HXTs for natural drive wells at least have used the "side-porting" of the controls interfaces between TH and HXT body to avoid complexity.

Figure 6:
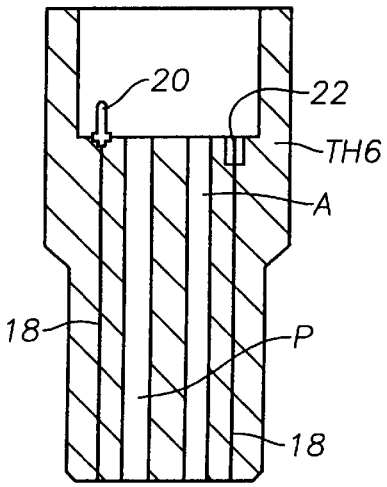
FIGS. 6 through 8 illustrate prior art hydraulic and electric coupler arrangements possible for communication (via the tubing hanger) through the wellhead to the well below.
Figure 7:
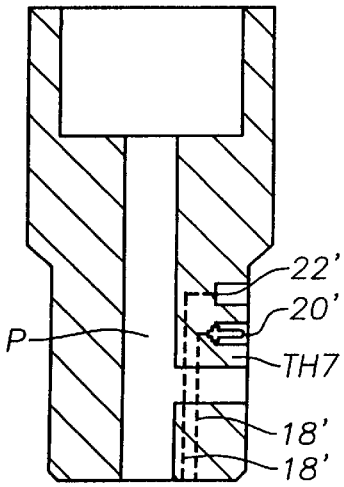
Figure 8:
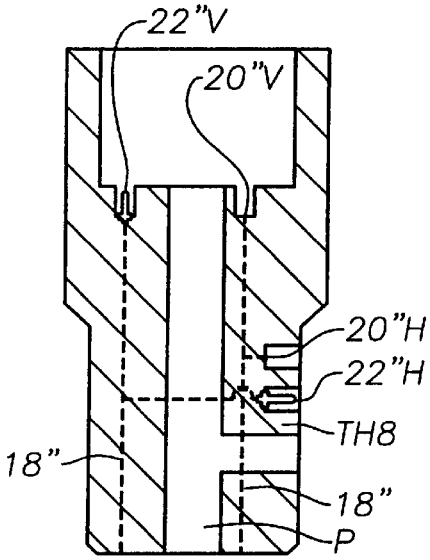

The VDB TH schematic of FIG. 6 shows a conventional tubing hanger TH6 for a VDB completion system. It shows a production bore P and an annulus bore A and shows that the E and H conduits 18 are routed in a generally vertical manner from the top to the bottom of the tubing hanger TH6. A hydraulic coupler 20 and an electric coupler 22 are schematically illustrated. The HXT TH schematic of FIG. 7 illustrates a tubing hanger TH7 for an HXT with the vertical interface of electric and hydraulic conduits 18' at the bottom of the TH and the generally horizontal or radial couplers 20', 22' interface at the side of the TH. If it is desired to accommodate monitoring of the electric continuity to downhole equipment throughout the completion installation process as discussed above, it is necessary to have dual remotely engageable E and H controls interfaces for an HXT system: one "facing up" for engaging the THRT and one "facing sideways" or radially for engaging the HXT body conduit transfer devices. FIG. 8 shows such an arrangement with vertical and radial couplers 20"V, 20"H for an electric lead coupler and vertical and radial hydraulic couplers 22"V, 22"H schematically illustrated. The arrangement of FIG. 8 adds complexity to the system and greatly increases the risk of failure. Furthermore, one conduit access point (vertical or horizontal) must be positively de-activated whenever the alternative access point (horizontal or vertical) is active. There are obviously significant cost and packaging considerations also imposed on the HXT system when enhanced to provide all desired features. The HXT TH8 schematically illustrated in FIG. 8 having both vertical and horizontal interfaces is typical of a system actually provided for a subsea application in the Mediterranean Ocean.

The question arises as to why the E and H conduits need to exit sideways for a HXT system? Why can't the controls interface be presented only at the top of the TH, for interface both by the THRT and HXT tree cap? Such an arrangement has been used effectively for electrical submersible pump (ESP) applications for which the wells have insufficient energy to produce on their own. The limitations for "natural drive" well applications have to do with (1) the number of tested pressure barriers that must be in place before the BOP stack can be removed from the top of the HXT, and (2) the ability to provide adequate well control in the event pressure comes to be trapped under an HXT tree cap. To date, HXTs used on natural drive wells have typically required tree caps that can be installed and retrieved through the bore of a BOP stack. Electric submersible pump (ESP) equipped HXT wells that cannot produce without artificial lift have been accepted with an "external" tree cap (which also facilitates passage for E and H lines between the TH and HXT mounted control system). Great complexity (number of functions, orientation, leak paths, etc.) and risk would be added if an "internal" tree cap were required also to conduit E and H controls. In fact, two caps would likely be required, one through-BOP installable; a second to route the control functions over to the HXT. The conduits between the external tree cap and the HXT would also be limited regarding the depth of water in which they can be operated, assuming they were to be comprised of flexible hoses. Conduits exposed externally to sea water pressure have a limited "collapse" resistance capability.

The fact that HXTs used on natural drive wells currently require an internal (through-BOP deployed) tree cap further increases the size penalty of HXT systems. This is because the tree cap needs a landing shoulder, seal bores, locking profiles, etc., all of which are generally larger than the diameter of the TH it will ultimately be positioned above.

The slimbore system of this invention, on the other hand, needs to pass nothing larger than the TH, THRT and landing string (LS) through the subsea BOP stack. A more or less conventional VDB or alternatively a "monobore" xmas tree (both of which are referred herein generically as conventional xmas trees, CXT) can be installed on top of the "slimbore" TS/TH like that of FIGS. 5A, 5B, because the outer profile of the "slimbore" tubing spool is a conventional 18¾" configuration. An associated tree cap for the CXT can be ROV deployed, which saves a trip between the surface and subsea tree, which would normally be required for CXT systems. Some advantages of using a subsea completion arrangement that does not include an HXT tree concern relative smaller size and lower weight. These advantages are important for deployment from some deepwater capable rigs. Furthermore, CXTs can be "intervened" using simpler tooling packages deployed from lower cost vessels.

Associated with the slimbore completion system permanently installed hardware (TS, TH, XT, etc.) of this invention as schematically illustrated in FIGS. 5A, 5B, are a suite of tools that make its installation and subsequent interface effective. The installation sequence of FIGS. 9 to 18 illustrate completion/intervention systems and running tools and methods for these activities.

Figure 9:
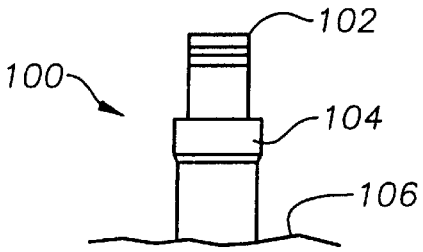
FIGS. 9 through 12 are schematic drawings which illustrate a preferred embodiment and installation sequence for a tubing hanger/tubing spool arrangement for a slimbore marine riser and slimbore BOP stack and with FIG. 12A showing in an enlarged view the annulus path in the tubing spool which extends around the tubing hanger landing location to form a bypass and with FIG. 12B showing a perspective view of the tubing spool with an external piping loop for the annulus path.

FIG. 9 shows a conventional subsea wellhead system 100, comprising a high pressure wellhead housing 102 and associated conductor housing and well conductor 104, installed at the subsea mudline 106. The internal components of the system 100 including casing hangers/casing strings and seal assemblies, etc., (not illustrated) are conventional in the art of subsea wellhead systems.

Figure 10:
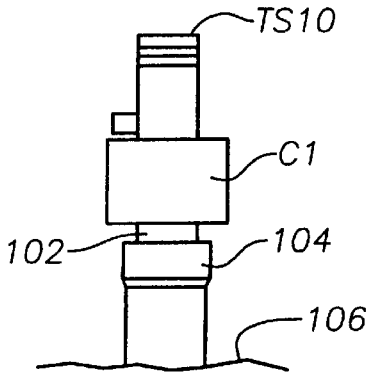

FIG. 10 shows a tubing spool TS10 (also known as a tubing "ahead"), secured on top of the high pressure wellhead housing 102 by means of a connector C1. The connector C1 is preferably a hydraulic wellhead connector which establishes a seal and locks the interface of the tubing spool TS10 to the wellhead housing 102. Other securing means can be used in place of the connector C1. The tubing spool TS10 provides an upward-facing profile which typically, but not necessarily, matches the profile of the wellhead housing 102. The tubing spool TS10 is constructed according to the arrangement illustrated in FIGS. 5A and 5B. It contains internal profiles and flow paths that are discussed below.

Figure 11:
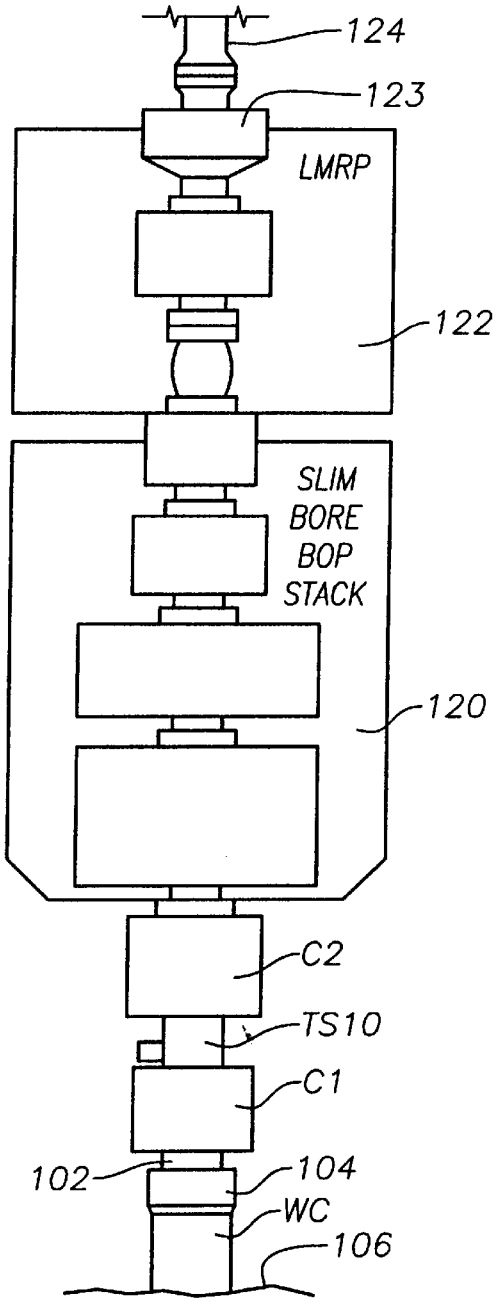

FIG. 11 shows a slimbore BOP stack 120 landed, locked and sealed (by means of hydraulic connector C2) on top of the tubing spool TS10 of FIG. 10. Slimbore in this context means that the I.D. of the BOP is about 13⅝". Connector C2 is arranged and designed to connect the 13⅝" nominal slimbore BOP stack to the (typically) 18¾" nominal configuration outer profile of tubing spool TS10. The purpose of the BOP stack 120 is primarily to provide well control capability local to the wellhead system components. An integral but independently separable part of the slimbore BOP stack is the lower marine riser package (LMRP) 122. It provides for quick release of the marine riser 124 from the slimbore BOP stack 120 in an emergency, such as would be required if the surface vessel to which the marine riser is connected were to move off location unexpectedly. Within the LMRP 122 is a "flex-joint" 123 that eases riser bending loads and the transition angle associated with the interface of the marine riser 124 with the substantially stiffer LMRP 122 and BOP stack 120 components. The LMRP 122 also contains redundant control modules, choke and kill line terminations and, typically, a redundant annular blow-out preventer. By retrieving the LMRP 122, any of these items can be repaired or replaced, if the need were to arise, without requiring that the BOP stack 120 be disturbed. This feature is important, because the BOP stack could be required to maintain well control.

The marine riser 124 itself is the component of the system that enables the BOP stack 120 to be lowered to and retrieved from the high pressure wellhead housing 102 (drilling mode) and tubing spool TS10 at sea floor 106. It is also, however, the conduit through which drilling and completion fluids are circulated, and through which all wellbore tools are deployed. The internal diameter of the marine riser defines to a significant extent (especially in deep water) the volume of fluids that must be handled by the associated deployment vessel, and also defines the maximum size of any elements that can pass through the riser. The internal diameters of the riser 124, the lower marine riser package 122 and the BOP stack 120 must be sufficient to pass the equipment and tooling that will be run into the bore of the tubing spool TS10 which is designed like the tubing spool TS5 of FIGS. 5A and 5B. The small internal bore diameter of tubing spool TS10, enabled by its arrangement with a tubing hanger having a production bore (but no annulus bore) and an increased number of E and H conduits, determines the minimum size acceptable for the inner diameter of BOP stack 120 and Lower Marine Riser Package 122 and marine riser 124. It is preferred that the tubing hanger TH12 (see FIG. 12 and FIG. 12A) have a maximum external diameter of slightly less than 11" and that the internal bore of BOP stack 120 and LMRP 122 be slightly greater, e.g., 11" drift so as to be able to pass tubing hanger TH12 through them. The internal diameter of marine completion riser 124 is preferably about 12".

Alternatively, for a slightly larger system the tubing hanger TH12 may have a maximum external diameter of slightly less than 13⅝", with the internal bore of BOP stack 120 and LMRP of slightly greater dimension, 13⅝" drift, and with the internal diameter of marine completion riser 124 about 14".

Figure 12:
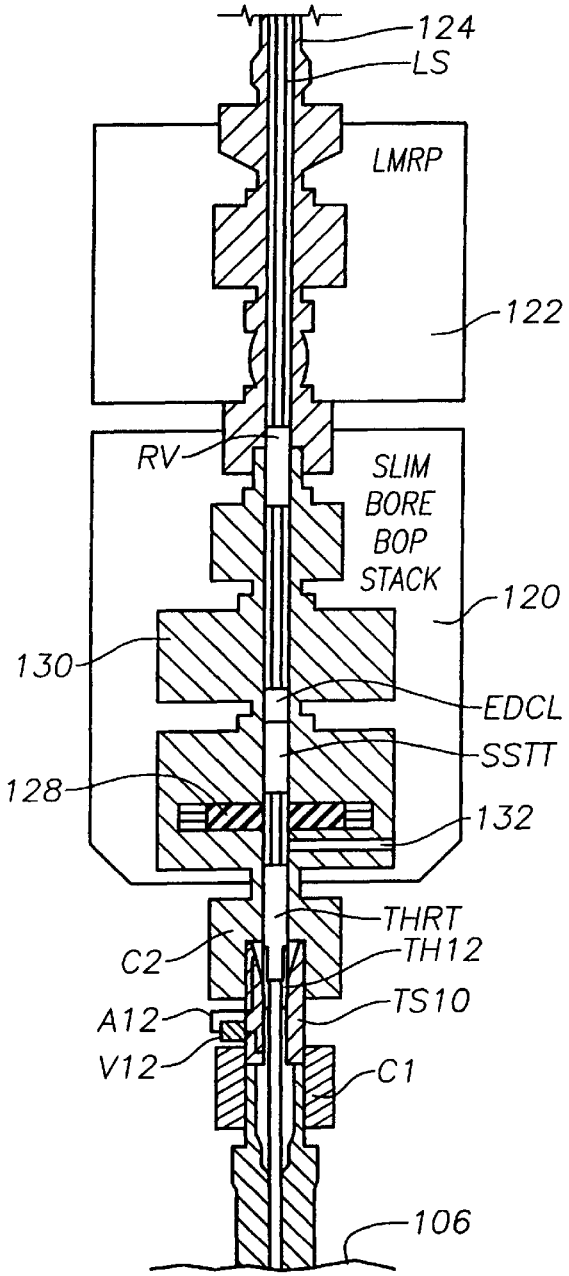
Figure 12A:
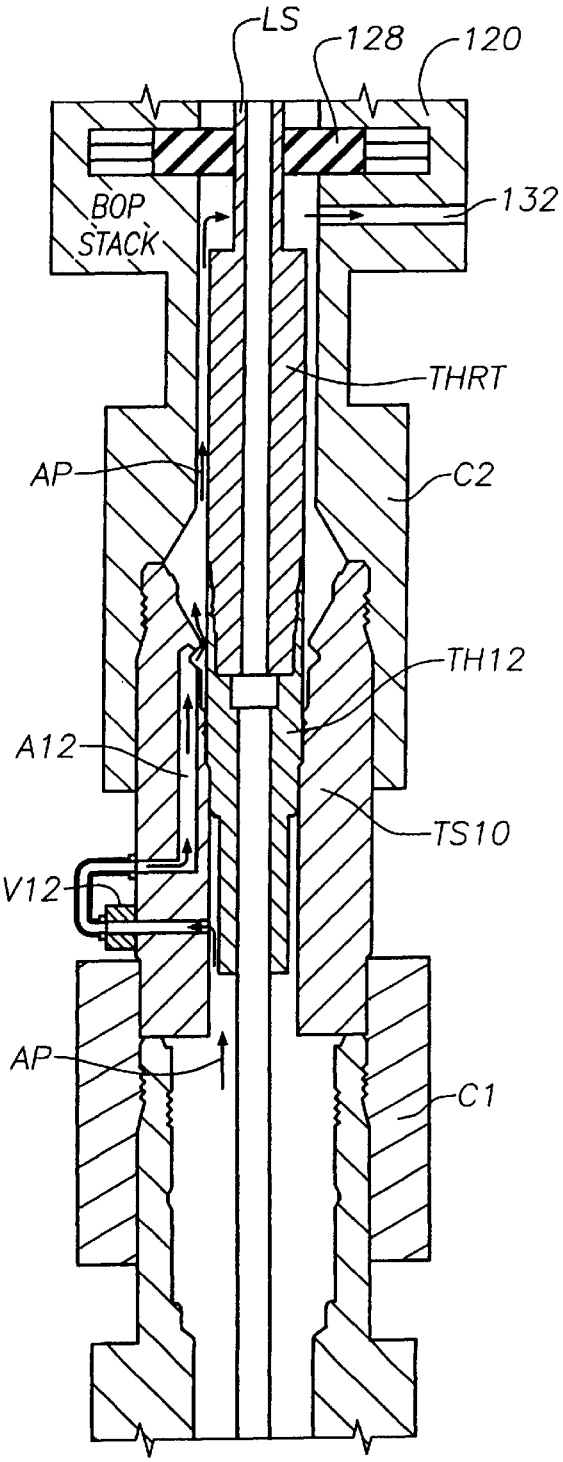
Figure 12B:
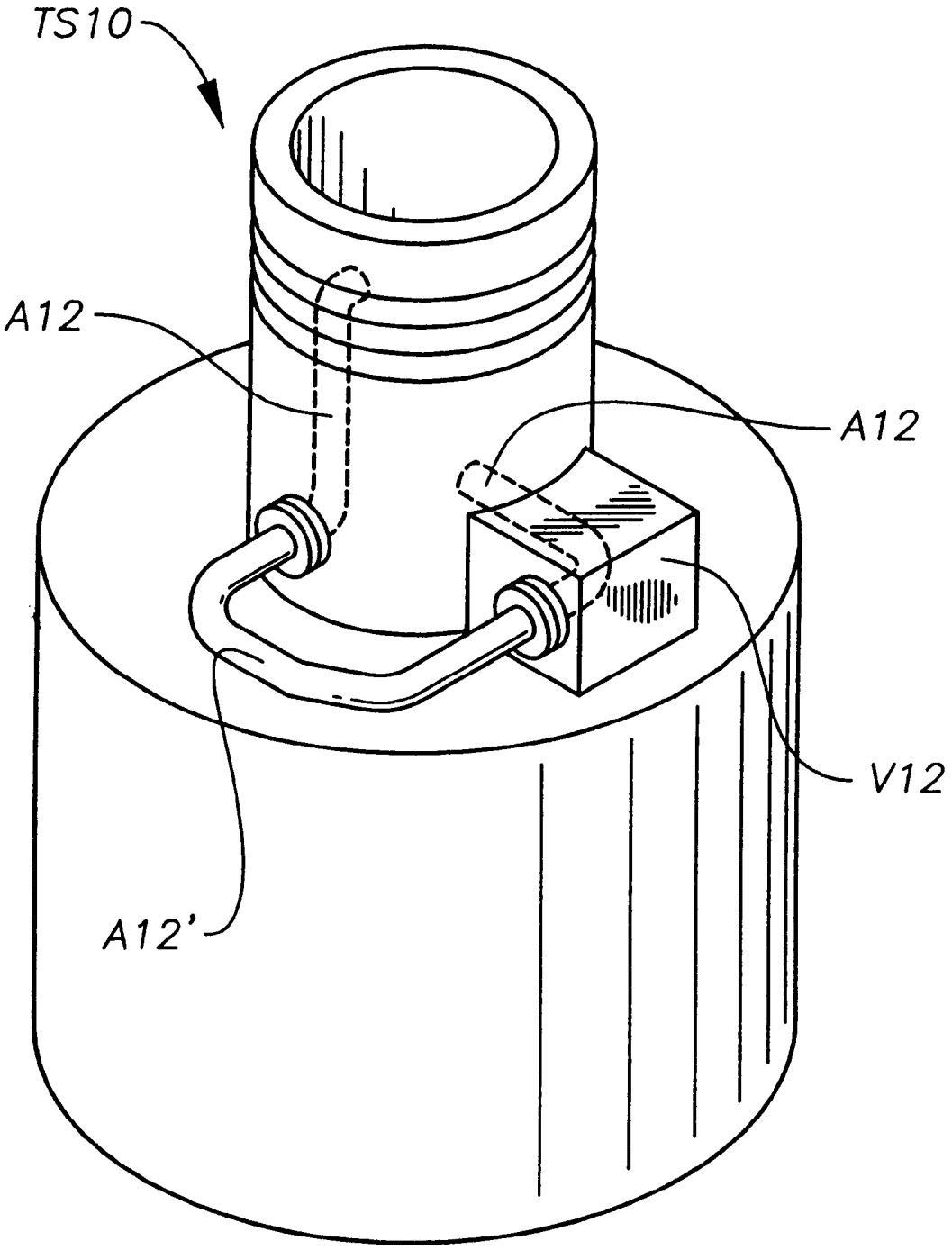

FIG. 12 shows a sectional view of FIG. 11. FIG. 12A shows an enlarged sectional view of FIG. 12. In FIGS. 12A and 12B the tubing hanger, TH12 has been landed, locked and sealed to the bore of the tubing spool TS10. The arrangement of tubing hanger/tubing spool TH12/TS10 is like that of TH5/TS5 of the schematic illustrations of FIGS. 5A, 5B. The orientation of the tubing hanger TH12 within the tubing spool TS10 is achieved passively by engagement typically of a tubing hanger—integral key into a tubing spool—fixed cam/vertical slot device (not shown). Alternative passive alignment arrangements are also known to those skilled in the art of well completions. For the arrangement shown in FIG. 12A, the key is preferably located below the tubing hanger TH12 landing shoulder, but another location for such a key may be provided. FIG. 12 and enlarged portion FIG. 12A further show an annulus path or passage A12 that allows communication of fluids around the tubing hanger TH12 (i.e., from above to below the sealed landing location of TH12/TS10, and vice-versa). This "bypass" path A12 is equipped with a remotely operable valve V12 that permits remote control closure of the passage A12 whenever desired, without the need for an associated wireline operation. FIG. 12A most clearly shows the completion landing string LS made up to the top of the tubing hanger TH12. The landing string LS is typically defined as everything above the tubing hanger TH12 as illustrated in FIG. 12.

As illustrated in FIG. 12, the subsea test tree SSTT and associated emergency disconnect latch EDCL (if required) are positioned above the lowermost BOP stack 120 ram 128 and below the BOP blind/shear ram 130. Such an arrangement is conventional. By closing the lowermost ram 128 on the pipe section between the tubing hanger running tool THRT and the subsea test tree, SSTT, the well annulus can be accessed via port A12 using the BOP stack choke and kill system flow paths 132. The communication path is illustrated by arrows AP in FIG. 12A. All of these system characteristics cooperate to enable use of a simple, tubing-based slimbore monobore landing string LS and a very small outside diameter (OD) tubing hanger TH12.

FIG. 12B is a perspective view of tubing spool TS10 which shows that the annulus path A12 may include an external piping loop A12' as an alternative to the internal conduit illustrated in FIG. 5A. The annulus bypass conduit may also reside fully within either a bolt-on or flange-on block attached to the side of the tubing spool TS10. Valve V12 is remotely controllable.

Figure 13:
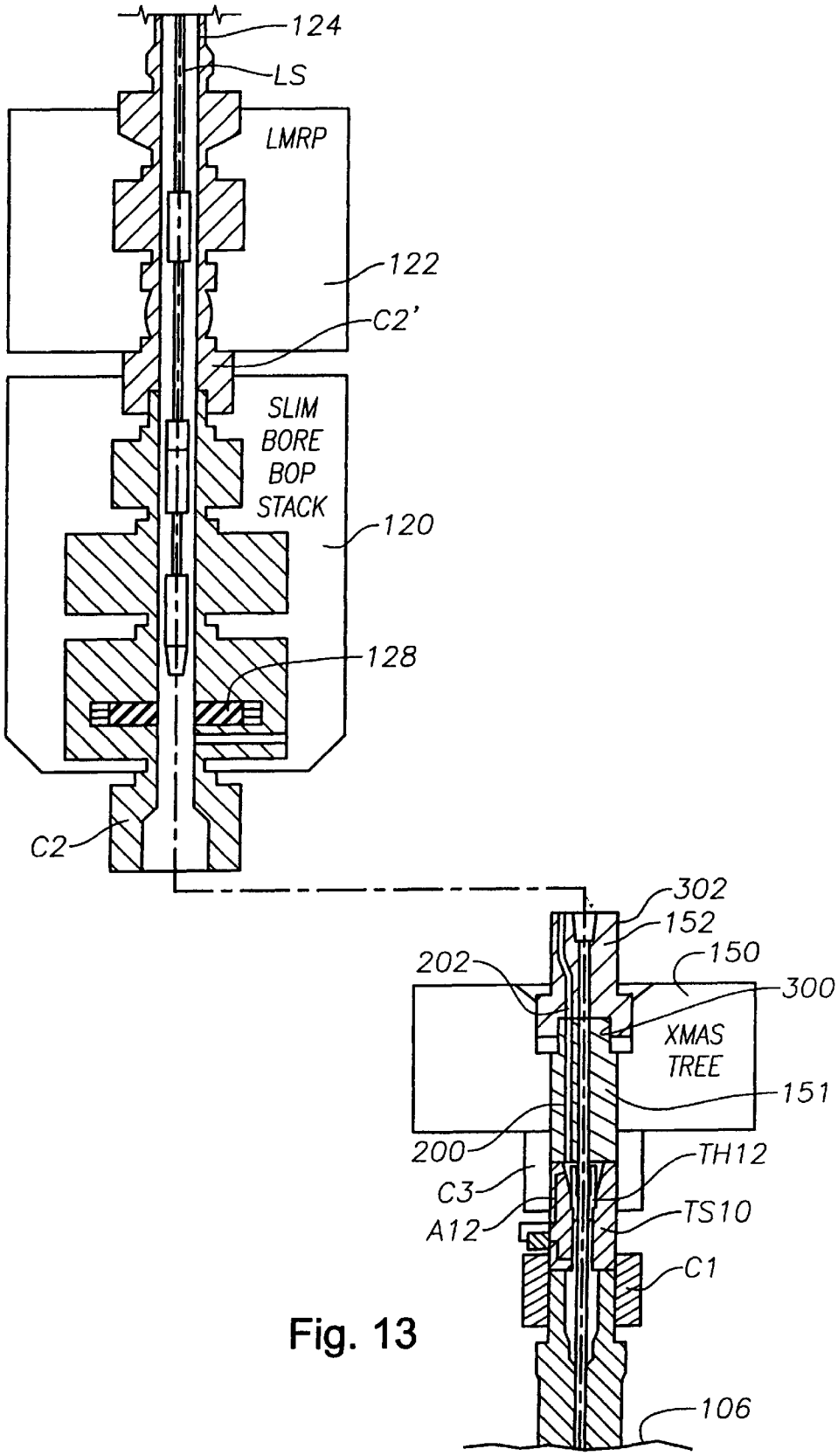
FIGS. 13 and 14 are schematic illustrations of xmas tree installation operations including removal of the slimbore BOP from the wellhead, installation of a xmas tree with an upwardly facing BOP adaptor, and reinstallation of the slimbore BOP on top of the XT.

FIG. 13 illustrates the state of the subsea system with the slimbore BOP stack 120/122 removed from the tubing spool TS10 (with the bottom of the landing string LS suspended therein) and offset laterally a relatively small distance from the top of the tubing spool TS10. FIG. 13 also shows that a subsea xmas tree 150 and BOP adaptor 152 have been installed in place of BOP 120 with connector C3 securing xmas tree 150 to tubing spool TS10. Connector C3 connects the xmas tree 150 to the typically 18¾" configuration nominal profile of the tubing spool TS10. The xmas tree 150 may be deployed to the tubing spool TS10 by means of a cable in coordination with a ROV, or on drill pipe or tubing, or even using the BOP stack 120 and/or landing string LS themselves as the transport devices. Note that for the case where a conventional size BOP stack is used in place of the slimbore system, it is also conceivable that the BOP stack could be "parked" on top of an appropriate seabed facility (typically a preset pile or another wellhead arrangement) and the LMRP used as the transport tool.

FIG. 13 further shows a BOP adaptor 152 removably secured to the top of the conventional xmas tree 150, preferably installed to the top of xmas tree 150 while it was on the vessel prior to deployment. Its purpose is to adapt the upper profile 300 of an otherwise conventional xmas tree (e.g., a 13⅝" clamp hub or similar profile as compared to a standard 18¾" configuration top interface) for an interface 302 with the larger connector C2, typically 18¾", on the bottom of the slimbore BOP stack 120, or the BOP stack LMRP 122 (with connector C2', for example) or a standard BOP stack 160 or its LMRP 170 (see FIG. 17). In other words, BOP adaptor 152 has a bottom profile of typically 13⅝" nominal configuration and a top profile 302 of 18¾" nominal configuration.

FIG. 13 illustrates the slimbore BOP stack 120 prior to its connection to the conventional xmas tree 150 by means of the BOP adaptor 152. The BOP adaptor 152 has an internal profile that emulates the upper internal profile of the tubing hanger TH12 so that the tubing hanger running tool THRT of landing string LS may be used to "tieback" the production bore of the xmas tree 150. In other words, the inner profile of the BOP adaptor 152 includes a central production bore and at least "dummy" plural E and H receptacles which match those of the tubing hanger, and also includes an annulus passage. The BOP adaptor 152 is arranged and designed to provide all interface/guidance facilities required, such as a guidelineless (GLL) re-entry funnel, if required (not shown).

Figure 14:
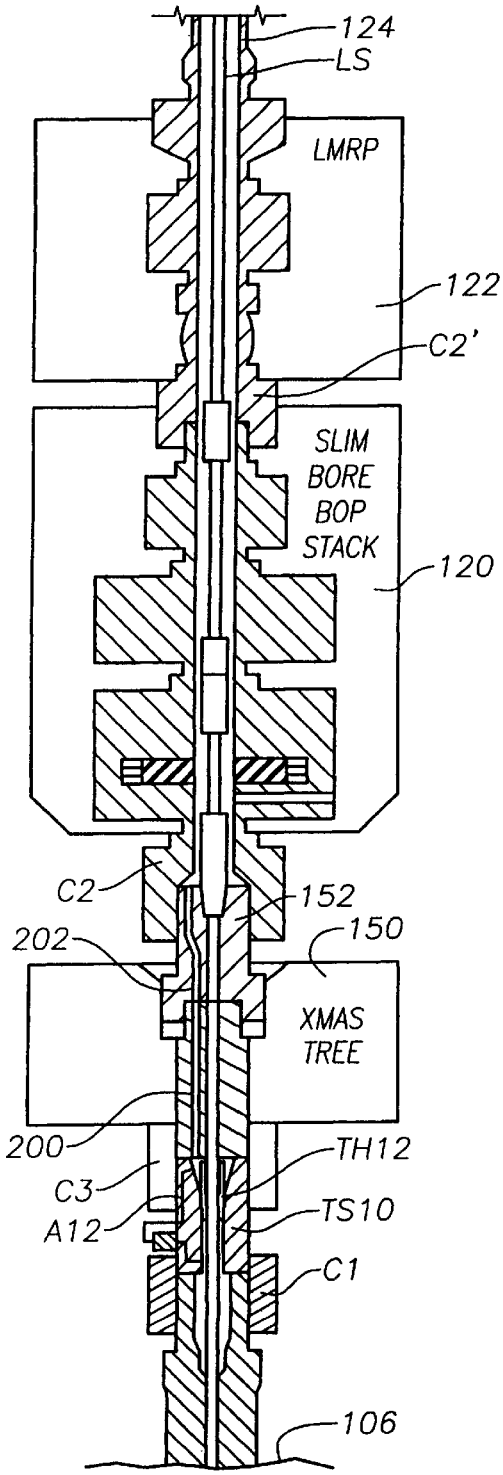
Figure 14A:
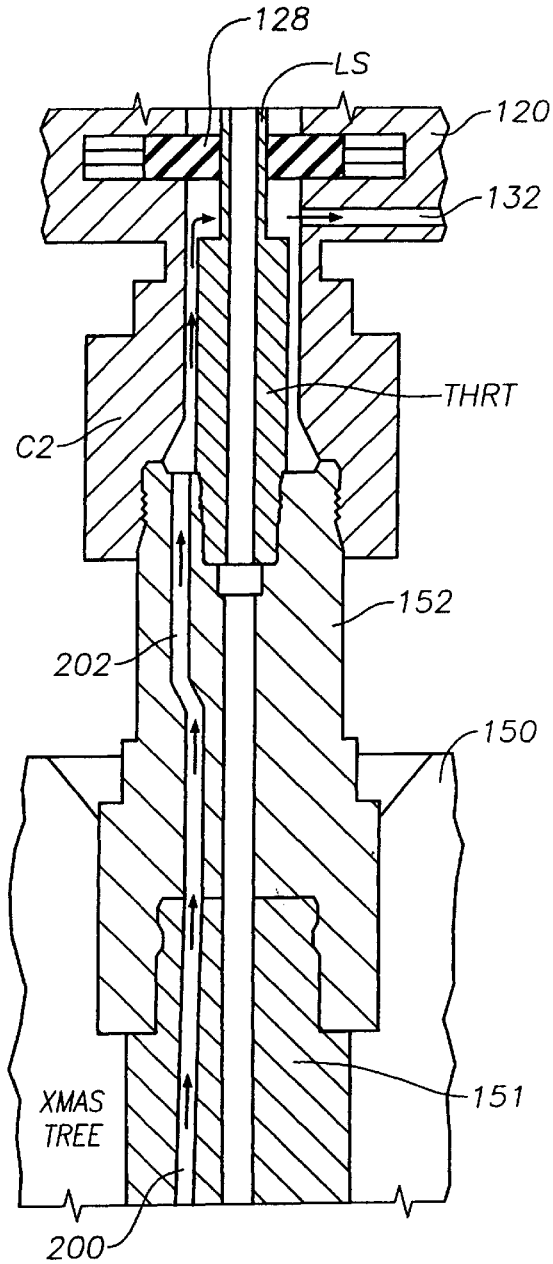
FIG. 14A presents an enlarged view of the annulus path through the xmas tree, BOP adaptor and BOP, and control of the path with the BOP choke and kill lines.
Figure 14B:
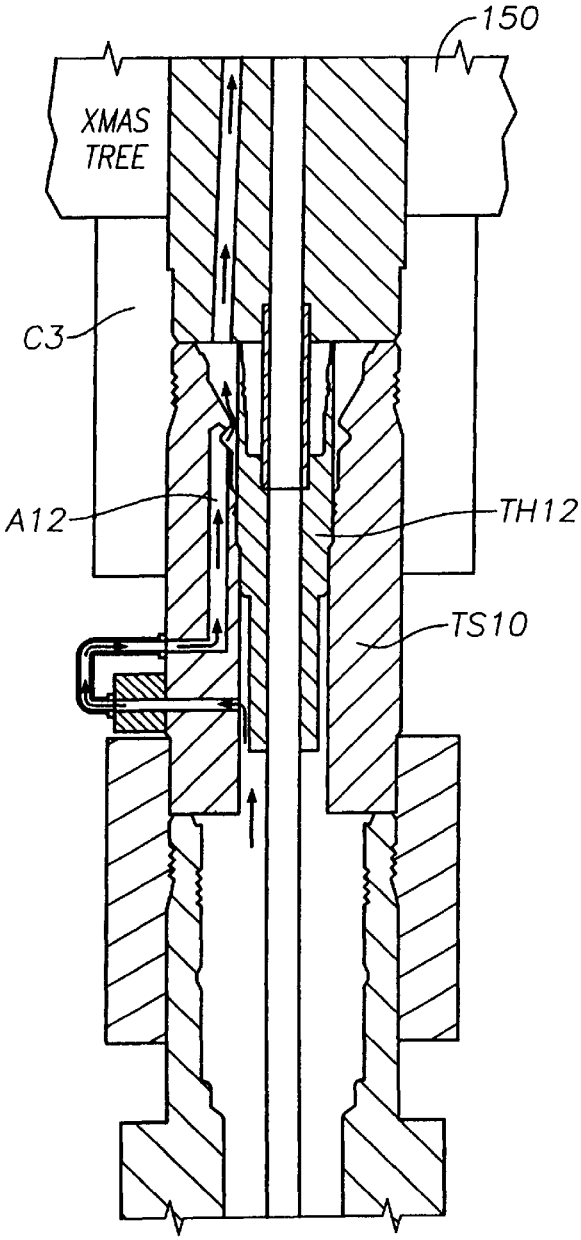
FIG. 14B shows the annulus path from the wellhead, through the tubing spool and into the xmas tree.

FIG. 14 and the enlarged sectional views of FIGS. 14A, 14B show the slimbore BOP stack 120 and landing string LS after engagement of connector C2 to the top of the BOP adaptor 152 and thereby to the 13⅝" re-entry hub 151 of xmas tree 150. The physical relationship between the landing string LS components and BOP stack 120 are identical to such relationship in FIG. 12 (orientation, elevation, etc.). Control of the annulus bore is by means of the choke and kill lines 132 of the BOP stack 120 via the annulus port A12 of FIG. 12A and of FIGS. 14 and 14B. Note that for the scenario where a conventional size LMRP 170 is interfaced with the BOP adaptor 152, receptacles and appropriate conduits for the choke and kill lines would have to be provided. The BOP adaptor 152 enables such identical physical arrangements along with various other advantages. Such advantages are listed below.

(1) The BOP stack 120 and landing string LS need not be retrieved to the surface to permit deployment/installation of the tree 150 as illustrated in FIG. 13. This advantage represents substantial cost savings because of the "trip time" saved (likely>$1 million f/deep water).

(2) Because the BOP adaptor 152 resides between the top of the xmas tree 150 and the bottom of a BOP connector C2 (or LMRP connector C2') the packaging of the xmas tree 150 upper profile need not be modified to accommodate the larger connector of an 18¾" BOP stack or LMRP to achieve the benefit of eliminating a trip of the BOP stack 120 to permit installation of the xmas tree 150.

(3) No special completion riser is required to install or intervene the xmas tree 150. Nevertheless, such a conventional approach could be used for the installation or any subsequent intervention or retrieval exercise simply by foregoing use of the BOP adaptor 152. In other words, the standard xmas tree top profile would not be changed.

(4) Standard (light weight) tubing/casing can be used to deploy the tubing hanger TH12, because the landing string LS is not required to be operated outside of the slimbore marine riser 124 (or even a conventional marine riser). This results in an advantage that tubing hanger TH12 can be installed with the benefit of "heave compensation" in deeper water, since the lighter weight landing string will not exceed the capacity of typical compensators (whereas most dedicated riser/landing string designs do).

(5) One and the same BOP adaptor 152 can be used to facilitate interface with a conventional (typically 18¾") BOP stack and/or LMRP, if a slimbore BOP stack 120 is not available. This assumes that a sufficiently strong bottom connector/XT top profile interface is provided.

Figure 15:
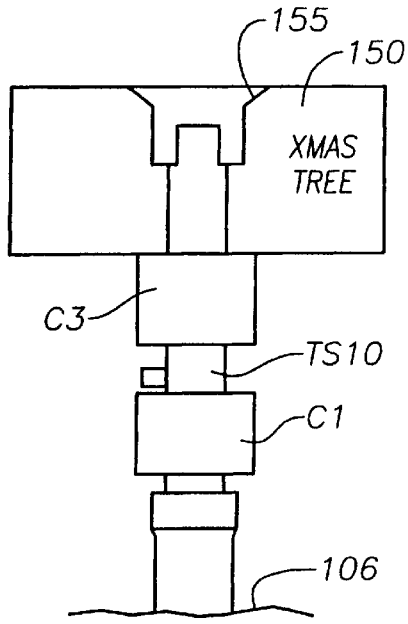
FIGS. 15 and 16 are schematic illustrations where the BOP stack and BOP adaptor have been removed from the top of the xmas tree and a tree cap has subsequently been installed in the top profile of the xmas tree respectively.

FIG. 15 shows the condition of the subsea well after the landing string LS, BOP stack 120, marine riser 124, and BOP adaptor 152 have been retrieved from the top of the xmas tree 150. The BOP adaptor 152 is retrieved during the same trip as retrieval of the BOP stack 120 in order to save a trip. Specifically, there are no dedicated trips (or tools) required for the BOP adaptor 152. It is installed already made up to the xmas tree 150, yet it can be retrieved at the same time as the BOP stack 120 or 160 (see FIG. 17 and discussion below) leaving the xmas tree 150 connected to tubing spool TS10. Retrieval of the xmas tree 150 by one approach is simply the reverse of the installation process. The BOP adaptor 152 may be secured to the bottom of an appropriate BOP stack 120 or LMRP 122, and the BOP adaptor 152 subsequently connected to xmas tree 150. After appropriate pressure barriers have been established in the wellbore, the xmas tree 50 may be retrieved. A variety of other means may also be employed to achieve securing the well and retrieving the tree (including use of a conventional completion/intervention riser system).

Figure 16:
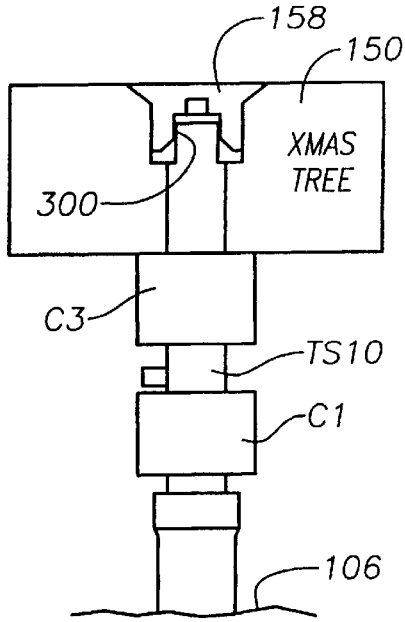

FIG. 16 shows a tree cap 158 installed to the top of the xmas tree 150 re-entry profile 300 as a conventional redundant barrier to the xmas tree swab valves and as a "critical surfaces" protector.

Figure 17:
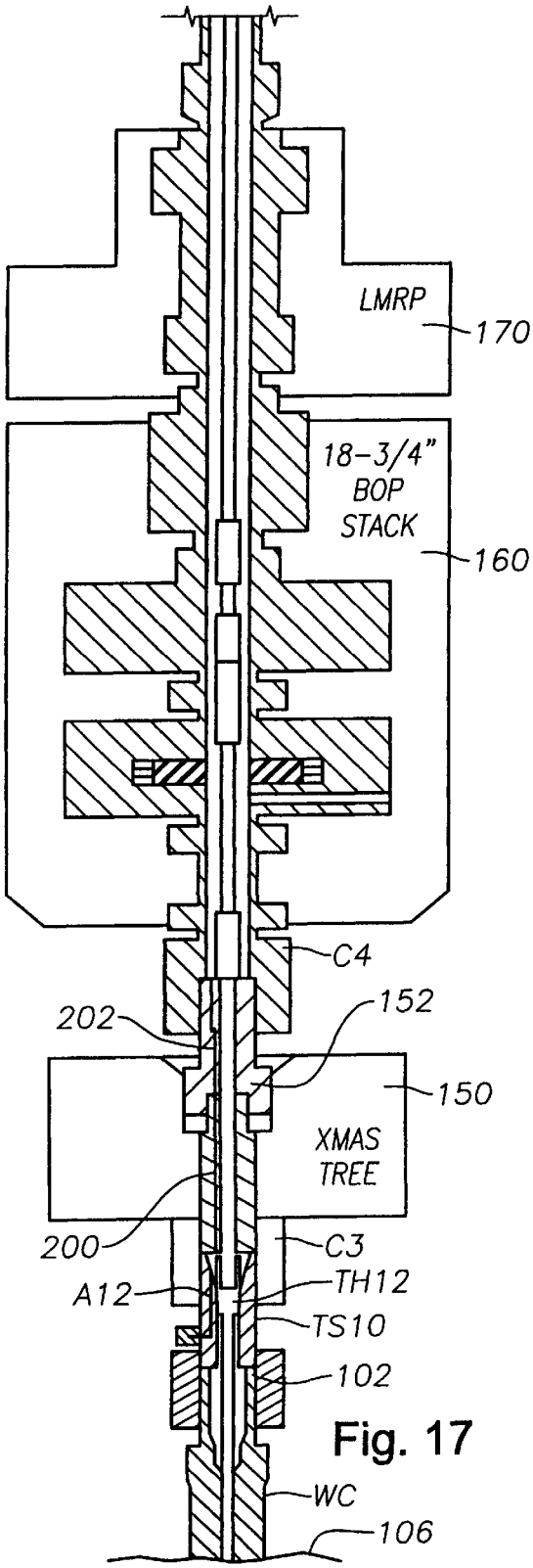
FIG. 17 shows a conventional (standard dimensions) BOP stack and marine riser system installed to the top profile of the xmas tree via the BOP adaptor.

FIG. 17 is essentially the same as FIG. 14, with the significant difference that the BOP stack 160 shown is a conventional deepwater 18¾" nominal size version. The BOP adaptor 152 is connected to the larger BOP stack 160 via the connector C4 attached to the 18¾" configuration profile at the top of the adaptor. Specifically, the BOP adaptor 152 provides a common top profile for interface of both slimbore and conventional BOP stacks.

Figure 18:
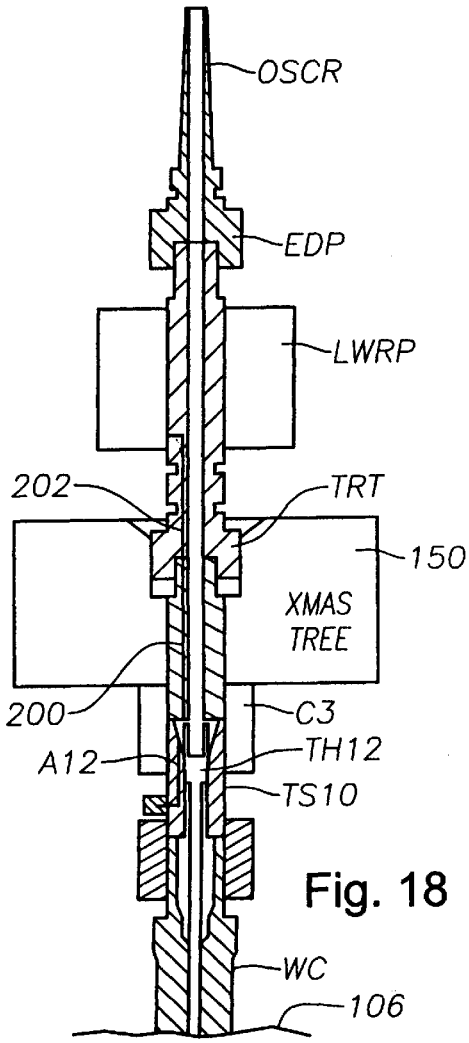
FIG. 18 illustrates the provision of a conventional workover/intervention riser secured to the top profile of the xmas tree.

FIG. 18 is an alternative arrangement for the xmas tree 150 secured to a slimbore tubing spool TS10/tubing hanger TH12 without the BOP adaptor being secured thereto for interface with a traditional approach open-sea completion/intervention riser. A tree running tool TRT secures a Lower Workover Riser Package (LWRP) and emergency disconnect package EDP to xmas tree 150. Because of the flexibility afforded by the BOP adaptor, there are few limitations as to the intervention configuration scenarios.

Summary of Advantageous Features For The Slimbore Completion System (1) The arrangement of a tubing spool TS5—tubing hanger TH5 of FIGS. 5A and 5B enables use of a slimbore BOP 120 and slimbore marine riser 124 to minimize riser fluid requirements. As a result, less volume of fluids is required, which results in less storage required, less weight to be handled, more available vessel deck space and load capacity for other needs. Alternatively, it provides the capability to reduce required vessel size to carry out desired operations, etc.—all contributing to lower cost to the field operator.

(2) The tubing hanger TH5/tubing spool TS5 arrangement of the invention accommodates a relatively large number of electric (E) and hydraulic (H) controls conduits through a very small diameter tubing hanger, which in turn matches the small diameter limitations of the slimbore riser system. The relatively large number of conduits satisfies both current and perceived future (expanded) requirements of "smart wells".

(3) Because of the vertical orientation of the control conduits 18 of tubing hanger TH5, downhole functions can be monitored for integrity throughout the installation process. This arrangement allows any damage related failures to be quickly and efficiently rectified as soon as they occur, a requirement for "smart well" applications. Because the xmas tree 150 is installed on top of the tubing hanger TH12 following its installation in tubing spool TS10, the same control interfaces used during the tubing hanger installation operation can be accessed for production mode (tree) requirements. As a result, there are fewer potential failure points as compared to traditional horizontal xmas tree HXT designs, providing comparable functionality.

(4) The BOP adaptor 152 arrangement of the invention facilitates interface of both slimbore (11" or 13⅝" bore) BOP stacks 120 and LMRPs 122, and conventional (18¾") BOP stacks 160 and LWRPs 170 with the top of the xmas tree, while also eliminating the requirement to provide a large (typically 18¾" nominal configuration) re-entry profile at the top of the xmas tree. The BOP adaptor 152 removes the interface problems normally associated with providing enough space to accept a "BOP stack of convenience", particularly for guidelineless (GLL) applications. An 18¾" (typical) top interface on a xmas tree would result in a substantial increase in the footprint (and therefore weight, handling difficulties, etc.) of the tree (especially for GLL applications), if the traditional requirement were imposed that control modules and choke trim/actuator modules, etc., be vertically retrievable by GLL means.

(5) The tubing hanger TH5 is characterized by a concentric production bore (no annulus conduit therethrough) and by concentrically arranged conventional vertically-oriented electric (E) and hydraulic (H) couplers for interfacing control functions. Should circumstances dictate (such as the desire to provide multiple completion strings or special/nonconventional profile E/H conduit connectors), the tubing hanger characteristics described above could be altered. Because the annulus conduit is not routed through the tubing hanger TH5, several modifications of the routing of the E and H conduits and/or their couplers may be made. So long as the annulus conduit is not routed through the TH, such modifications should be considered to be anticipated by the subject invention.

(6) The tubing hanger TH5/Tubing Spool TS5 arrangement of the invention represents a hybrid of the conventional (vertical bore) tree and horizontal tree completion systems.

(7) The subsea arrangement described above allows use of more or less conventional vertical dual bore or "monobore" xmas trees which have size and weight advantages compared with horizontal xmas trees, especially for guidelineless applications. The enhanced design features such as an ROV deployed tree cap (see tree cap 158 of FIG. 16) and optimized installation procedures give these slimbore "conventional" trees further advantages in comparison to HXT designs. For example, a conventional xmas tree can be "intervened" using a simpler tooling package deployed from a lower cost vessel.

(8) The BOP adaptor depicted in FIGS. 13, 14 and 14A provides the capability to use the BOP stack/marine riser and completion landing string (based on standard tubing) in both the tubing hanger interface mode of FIG. 12 and the xmas tree interface mode of FIGS. 14, 14A and 14B. This capability removes the requirement to retrieve the BOP stack 120 (or the larger BOP stack 160, if used) to permit installation of the xmas tree using a dedicated open-sea completion/intervention (C/I) riser. On the other hand, the system also retains the ability to interface a conventional C/I riser, should this be desired (see FIG. 18). The flexibility of the latter feature (allowing lower cost interventions), combined with the cost savings of the first feature (trip time savings plus Capital Expense (CAPEX) savings are key advantages of the BOP adaptor 152 of the invention.

(9) The tubing hanger/tubing spool arrangement of FIGS. 5A and 5B of the invention incorporates a tubing spool to accept the tubing hanger and in which a conduit is provided for annulus communication "around", rather than "through" the tubing hanger. This feature enables a substantial size reduction for the tubing hanger. The annulus "bypass" conduit A5 is routed past one or more (but typically one) remotely operable (actuated or manual/ROV operated, etc.) valves VA5, VA6 incorporated either integral to the TS body or unitized thereto. This valve VA5 (for example) provides closure capability for the annulus conduit that does not require wireline trips for operation. This results in cost savings and reliability improvement from many perspectives—not least of which is that it permits use of a true monobore riser (that is, no "diverter" required, simple tubing possibly acceptable, etc.). In the tubing hanger intervention modes, annulus communication is achieved in cooperation with the BOP stack choke and kill conduits, without the requirement for incorporating special rams in the BOP or relying on the annular blow out preventers for high pressure sealing. In the xmas tree intervention mode, annulus communication is achieved in the same manner (unless a dedicated traditional type open-sea completion/intervention riser is employed), although in this mode there will be a xmas tree 150 placed between the tubing spool TS10 and BOP stack 120, 160 (see FIGS. 14A, 14B and 17). The xmas tree 150 provides an annulus flow conduit from its bottom surface to its upper re-entry profile (via one or more valves), not shown, integral to the xmas tree block or unitized to the side thereof. See conduit 200 in xmas tree 150 and associated conduit 202 of BOP adaptor 152 in FIGS. 13, 14, 14A, 17 and 18. The annulus bypass conduit A12 around the tubing hanger is contained completely within the tubing spool TS10, as opposed to the xmas tree body as is the case for horizontal xmas tree designs. All benefits normally associated with tubing spools are incorporated in the arrangement of the invention.

(10) Special handling operations as depicted in FIGS. 12, 12A, 13, 14, 14A and 14B can save BOP stack /marine riser, and completion riser trips between the sea floor and the surface, in comparison to conventional operations.

While preferred embodiments of the present invention have been illustrated and/or described in some detail, modifications and adaptions of the preferred embodiments will occur to those skilled in the art. Such modifications and adaptations are within the spirit and scope of the resent invention.

What is claimed is:

1. A method of completing a subsea well comprising the steps of, running a BOP stack by means of a marine riser from a surface vessel for connection of a bottom end of said BOP stack to the top of a wellhead at a seabed, disconnecting said BOP stack and marine riser from said wellhead, removing said BOP stack and marine riser a sufficient lateral distance above said seabed, but substantially short of retrieving said BOP stack and marine riser back to the surface, to facilitate installation of a xmas tree onto said wellhead, connecting a bottom end of said xmas tree to said top of said wellhead, moving said BOP stack by means of said marine riser to a top end of said xmas tree for connection thereto, and connecting a bottom end of said BOP stack to said top end of said xmas tree.

2. The method of claim 1 wherein, said xmas tree is positioned to the top of said wellhead independently of said BOP stack.

3. The method of claim 1 further comprising the step of, lowering said xmas tree to said wellhead independently of said marine riser.

4. The method of claim 3 wherein, said lowering step is characterized by lowering said xmas tree from a vessel to said top of said wellhead by means of a cable.

5. The method of claim 3 wherein, said lowering step is characterized by lowering said xmas tree from a vessel to said top of said wellhead by means of drill pipe.

6. The method of claim 3 wherein, said lowering step is characterized by lowering said xmas tree by means of tubing.

7. The method of claim 1 further comprising the steps of, lowering said xmas tree to a parked location at a sufficient lateral distance from said wellhead before said step of disconnecting said BOP stack from said wellhead, and after said step of disconnecting said BOP stack from said wellhead, securing the bottom of the BOP stack to the xmas tree at said parked location and moving said xmas tree and connected BOP stack to the top of said wellhead.

8. The method of claim 7 wherein, said step of lowering said xmas tree to a parked location is performed independently of said marine riser.

9. The method of claim 1 wherein, said BOP stack includes a lower marine riser package (LMRP) connected between a top of said BOP stack and said marine riser, and the method further comprising the steps of lowering said xmas tree to a parked location at a relatively small lateral distance from said wellhead, and after said step of disconnecting said BOP stack and marine riser from said wellhead, disconnecting said LMRP from said BOP stack, parking said BOP stack at a seabed position, connecting a bottom end of said LMRP to said top end of said xmas tree, and moving said parked xmas tree with said marine riser and LMRP to said top of said wellhead.

10. The method of claim 1 wherein, said BOP stack includes a landing string through a bore of said stack having a running tool connected at the lower end of the landing string, and the method further comprising the steps of, lowering said xmas tree to a parked location at a relatively small distance from said wellhead, and after said step of disconnecting said BOP stack from said wellhead, positioning said BOP stack over said parked xmas tree, lowering said landing string and said running tool through and out the bottom of said BOP stack and connecting said running tool to said xmas tree, raising said xmas tree up under said BOP stack and connecting it thereto, and moving said xmas tree to said top of said wellhead.

11. The method of claim 1 wherein, said BOP stack includes a lower marine riser package (LMRP) and a landing string through a bore of said stack having a running tool connected at the lower end of the landing string, and the method further comprising the steps of lowering said xmas tree to a parked location at a relatively small distance from said wellhead, and after said step of disconnecting said BOP stack from said wellhead, parking said BOP stack at a seabed position, disconnecting said LMRP from said BOP stack, positioning said LMRP over said parked xmas tree, lowering said landing string and said running tool through and out of the bottom of said LMRP and connecting said running tool to said xmas tree, raising said xmas tree up under said LMRP, and connecting it thereto, and moving said xmas tree to said top of said wellhead.

12. The method of claim 1 further comprising the steps of, removing said BOP stack from said top end of said xmas tree, and installing a tree cap at said top end of said xmas tree.

13. The method of claim 9 further comprising the steps of, removing said LMRP from said top end of said xmas tree, and installing a tree cap at said top end of said xmas tree.

14. The method of claim 12 further comprising the steps of, removing said tree cap at said top end of said xmas tree, and re-installing a BOP to said top of said xmas tree.

15. The method of claim 13 further comprising the steps of removing said tree cap at said top end of said xmas tree, and re-installing a LMRP to said top of said xmas tree.

16. The method of claim 13 further comprising the steps of, removing said tree cap at said top end of said xmas tree, and re-installing a BOP to said top of said xmas tree.

17. The method of claim 13 further comprising the steps of, removing said tree cap at said top end of said xmas tree, and re-installing a LMRP to said top of said xmas tree.

18. The method of claim 1 further comprising the steps of, installing a BOP adaptor to a top profile at said top end of said xmas tree, and said step of connecting said BOP stack to said top end of said xmas tree includes the step of connecting said bottom end of said BOP stack to said BOP adaptor.

19. The method of claim 18 further comprising the steps of, removing said BOP stack with said BOP adaptor from said xmas tree top profile, and installing a tree cap at said top profile of said xmas tree.

20. The method of claim 19 further comprising the steps of, removing said tree cap from said top profile of said xmas tree, installing said BOP adaptor to a bottom end of said BOP stack, and moving said BOP stack and said BOP adaptor to said top of said xmas tree, and connecting said BOP adaptor, while connected to said BOP stack, to said top profile of said xmas tree.

21. The method of claim 19 further comprising the steps of, removing said tree cap from said top profile of said xmas tree, lowering a lower workover riser package by means of an open-sea completion/intervention riser to said xmas tree, and connecting said lower workover riser package to said top profile of said xmas tree.

22. The method of claim 1 wherein, said BOP stack includes a lower marine riser package (LMRP), and the method further comprising the steps of installing a BOP adaptor to a top profile at said top end of said xmas tree, and said step of connecting said marine riser to said top end of said xmas tree includes the steps of disconnecting said BOP stack from said LMRP and connecting said LMRP to said BOP adaptor.

23. The method of claim 22 further comprising the steps of, removing said LMRP with said BOP adaptor from said xmas tree top profile, and installing a tree cap at said top profile of said xmas tree.

24. The method of claim 23 further comprising the steps of, removing said tree cap from said top profile of said xmas tree, installing a BOP adaptor to a bottom end of a BOP stack, and moving said BOP stack and BOP adaptor to said top of said xmas tree, and connecting said BOP adaptor, while connected to said BOP stack, to said top profile of said xmas tree.

25. The method of claim 24 further comprising the steps of, removing said tree cap from said top profile of said xmas tree, lowering a lower workover riser package by means of an open-sea completion/intervention riser to said xmas tree, and connecting said lower workover riser package to said top profile of said xmas tree.

26. The method of claim 1 further comprising the step of, parking a BOP adaptor prior to said step of connecting a bottom end of said BOP stack to said top end of said xmas tree.

27. The method of claim 26 wherein, said step of connecting said BOP stack to said top end of said xmas tree includes the step of, first connecting said bottom end of said BOP stack to said parked BOP adaptor, and next connecting the BOP stack and connected BOP adaptor to said top end of said xmas tree.

28. The method of claim 26 wherein, said adaptor is run by drill pipe.

29. The method of claim 26 wherein said adaptor is run by tubing.

30. The method of claim 19 wherein, said BOP adaptor is removed independently of said BOP stack.

31. The method of claim 1 wherein, said BOP stack is characterized by a slimbore having a substantially smaller diameter than a standard bore of an 18¾" BOP stack.

32. The method of claim 31 further comprising the steps of installing a BOP adaptor to a top profile at said top end of said xmas tree, and said step of connecting said BOP stack to said top end of said xmas tree includes the step of connecting said bottom end of said BOP stack to said BOP adaptor.

33. The method of claim 32 further comprising the steps of removing said BOP stack with said BOP adaptor from said xmas tree top profile, and installing a tree cap at said top profile of said xmas tree.

34. The method of claim 33 further comprising the steps of removing the said tree cap from said top profile of said xmas tree, installing said BOP adaptor to a bottom end of an 18¾" BOP stack, and moving said 18¾" BOP stack and said BOP adaptor to said top of said xmas tree, and connecting said BOP adaptor, while connected to said BOP stack, to said profile of said xmas tree.

35. A method of completing a subsea well comprising the steps of, attaching a tubing spool having internal interface profiles to a wellhead housing, running a BOP stack by means of a marine riser and Lower Marine Riser Package (LMRP) from a surface vessel for connection of a bottom end of said BOP stack to a top profile of said tubing spool, running a tubing hanger having an external diameter sized to pass through said bore of said BOP stack for landing in said internal interface profiles of said tubing spool, disconnecting said BOP stack from said top of said tubing spool and moving said BOP stack a minimal distance therefrom, well short of retrieving said BOP stack to the surface, connecting a xmas tree to said top of said tubing spool, said xmas tree having a BOP adaptor which has a bottom end connected to a top profile of said xmas tree and a top end sized and arranged for securement to said bottom end of said BOP stack, and connecting said bottom end of said BOP stack to said top end of said BOP adaptor.

36. The method of claim 35 further comprising the step of, deploying said xmas tree and BOP adaptor to said top of said tubing spool independently of said marine riser.

37. The method of claim 36 wherein, said deploying step includes lowering said xmas tree and BOP adaptor by means of a cable from a surface location.

38. The method of claim 36 wherein, said deploying step includes lowering said xmas tree and BOP adaptor by means of a drill pipe string.

39. The method of claim 36 wherein, said deploying step includes lowering said xmas tree and BOP adaptor by means of a tubing string.

40. The method of claim 35 wherein, said xmas tree and BOP adaptor are parked at a seabed location, and further comprising the step of, moving said xmas tree and BOP adaptor from said parked location to said top of said tubing spool.

41. The method of claim 40 wherein, said moving step includes attaching said BOP stack to said top end of said BOP adaptor, and transferring said BOP stack, BOP adaptor and xmas tree to the top of said tubing spool by means of said marine riser.

42. The method of claim 40 wherein, said moving step includes attaching said LMRP to said top end of said BOP adaptor, and transferring said LMRP, BOP adaptor and xmas tree to the top of said tubing spool by means of said marine riser.

43. The method of claim 40 wherein, said moving step includes using a running tool on the bottom end of a landing string which extends through said marine riser and said BOP stack, said method further comprising the steps of using said landing string and said running tool to raise said BOP adaptor and xmas tree for connection to the bottom of said BOP stack, and then using said marine riser and said Bop stack to move said BOP adaptor and said xmas tree to the top of said tubing spool.

44. The method of claim 40 wherein, said moving step includes using a running tool on the bottom end of a landing string which extends through said marine riser and said LMRP, said method further comprising the steps of, using said landing string and said running tool to raise said BOP adaptor and xmas tree for connection to the bottom of said LMRP, and then using said marine riser and said LMRP to move said BOP adaptor and said xmas tree to the top of said tubing spool.

45. The method of claim 35 wherein, said BOP stack, LMRP and marine riser are characterized by a slimbore defined as having an internal bore which is substantially less than that of a standard 18¾" BOP stack and associated riser system, and said top profile of said tubing spool is of 18¾" nominal bore configuration.

46. The method of claim 45 wherein, said xmas tree is characterized by a re-entry hub of typically 13⅝" nominal bore configuration and said BOP adaptor is arranged and designed to connect to said re-entry hub at a lower end and having an adaptor profile at a top end of 18¾" nominal bore configuration.

47. The method of claim 35 wherein, said tubing spool has a body through which an annulus conduit runs from a location below a sealing location of said tubing hanger to a location above said sealing location, and wherein, said step of running said tubing hanger for landing in said tubing spool includes the step of carrying a string of production or injection tubing for insertion into the well while being supported by said tubing hanger, and said xmas tree includes production or injection and annulus conduits and said step of connecting said xmas tree to said top of said tubing spool includes the step of connecting said production or injection bore of said xmas tree to said production or injection conduit carried by said tubing hanger and interfacing said annulus bore of said xmas tree with said annulus conduit in said tubing spool at said location above said tubing hanger sealing location.

48. The method of claim 35 including the step of, running said tubing hanger on the end of a landing string through said marine riser and through said bore of said BOP stack.

49. The method of claim 48 including the step of, connecting a tubing hanger running tool at the end of said landing string to said tubing hanger, and running said tubing hanger through said marine riser and said bore of said BOP stack for landing said tubing hanger in said interface profile of said tubing spool.

50. The method of claim 49 further comprising the steps of, disconnecting said running tool from said tubing hanger, and prior to said step of disconnecting said BOP stack from said top of said tubing spool, lifting said landing string clear of said tubing spool, and removing said BOP stack and landing string a sufficient lateral distance to facilitate installation of said xmas tree onto said tubing spool.

51. The method of claim 35 further comprising the steps of, removing said BOP and said BOP adaptor from said top end of said xmas tree, and installing a tree cap at said top end of said xmas tree.

52. The method of claim 51 further comprising the steps of, removing said tree cap at said top of said xmas tree, connecting said BOP adaptor to the bottom of said BOP stack, moving said BOP stack and BOP adaptor to said top of said xmas tree, and connecting said BOP stack and said BOP adaptor to said top of said xmas tree.

53. The method of claim 52 further comprising the steps of, removing said tree cap from said top profile of said xmas tree, lowering a lower workover riser package by means of an open-sea completion/intervention riser to said xmas tree, and connecting said lower workover riser package to said top profile of said xmas tree.

54. The method of claim 35 further comprising the step of, parking said BOP adaptor at a sea bed position prior to said step of connecting said BOP adaptor to said top end of said xmas tree.

55. The method of claim 54 further comprising the steps of, connecting said bottom end of said BOP stack to said parked BOP adaptor, and connecting the BOP stack and BOP adaptor to said top end of said xmas tree.

56. The method of claim 54 wherein, said adaptor is parked by running it to the sea bed by drill pipe.

57. The method of claim 54 wherein, said adaptor is parked by running it to the sea bed by tubing.

58. The method of claim 51 wherein, said BOP adaptor is removed independently of said BOP stack.

* * * * *